US007537431B1

(12) United States Patent
Liang

(10) Patent No.: US 7,537,431 B1
(45) Date of Patent: May 26, 2009

(54) TURBINE BLADE TIP WITH MINI-SERPENTINE COOLING CIRCUIT

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 452 days.

(21) Appl. No.: 11/508,013

(22) Filed: Aug. 21, 2006

(51) Int. Cl.
*F01D 5/08* (2006.01)
*F01D 5/18* (2006.01)

(52) U.S. Cl. ..... 416/95; 415/115; 416/97 R

(58) Field of Classification Search ..... 415/115; 416/95, 97 A, 97 R
See application file for complete search history.

(56) References Cited

U.S. PATENT DOCUMENTS 4,247,254 A 1/1981 Zelahy
4,487,550 A * 12/1984 Horvath et al. ..... 416/92
4,589,823 A * 5/1986 Koffel ..... 416/92
5,403,158 A 4/1995 Auxier
5,511,946 A 4/1996 Lee et al.
5,660,523 A 8/1997 Lee
6,494,678 B1 12/2002 Bunker
6,558,119 B2 5/2003 Lee et al.
6,705,831 B2 * 3/2004 Draper ..... 415/115
6,916,150 B2 7/2005 Liang
6,932,571 B2 8/2005 Cunha et al.

* cited by examiner

*Primary Examiner*—Igor Kershteyn
(74) *Attorney, Agent, or Firm*—John Ryznic

(57) ABSTRACT

A turbine blade having a cooling supply passage formed within the blade, and a blade tip with a squealer tip formed thereon. The blade tip includes a blade top or cap, and includes a plurality of mini-serpentine cooling channels formed within the tip. The mini-serpentine channels can be 2-pass, 3-pass, 4-pass, or 5-pass serpentine channels, and each includes an inlet hole connected to the internal cooling supply passage to pass cooling air through the channels. Each channel includes an exit hole with a diffuser that opens onto the pressure side of the blade to provide film cooling. The mini-serpentine cooling channels can be arranged to flow substantially from blade side to side or from blade edge to edge.

12 Claims, 3 Drawing Sheets

TURBINE BLADE TIP WITH MINI-SERPENTINE COOLING CIRCUIT

CROSS-REFERENCE TO RELATED APPLICATIONS

This application relates to co-pending and recently filed regular patent application Ser. No. 11/503,549 entitled TURBINE AIRFOIL WITH MINI-SERPENTINE COOLING PASSAGES.

BACKGROUND OF THE INVENTION

1. Field of the Invention

The present invention relates generally to fluid reaction surfaces, and more specifically to a gas turbine blade with tip cooling.

2. Description of the Related Art including information disclosed under 37 CFR 1.97 and A gas turbine engine includes a turbine section with a plurality of rotor blade stages. A compressor supplies compressed air to a combustor to produce a hot gas flow through the turbine resulting in the generation of mechanical power. The rotating blades of the turbine form a seal between the blade tips and the outer shroud wall of the turbine. Thus, a seal is formed between two relatively rotating members of the turbine.

Leakage across this seal reduces the engine efficiency. Also, the leakage is hot gas flowing between the tip and the shroud. This hot gas flow on the tip will cause heating of the blade tip resulting in excessive wear or damage to the tip and shroud.

Rubbing of the tip against the shroud is also a problem because of thermal expansion of the blade from the heat load and from the centrifugal force developed in the blade from the rotation thereof. Squealer tips have been developed to provide a tip seal and to limit the amount of blade material that can rub. Cooling of the squealer tip is necessary to prevent the tip from overheating. Leakage in to the squealer tip cavity of the hot gas flow will cause the balder tip region to overheat.

U.S. Pat. No. 4,247,254 issued to Zelahy on Jan. 27, 1981 entitled TURBOMACHINERY BLADE WITH IMPROVED TIP CAP discloses a squealer tip for a turbine blade with cooling holes on the tip cal to inject cooling air into the cavity formed within the sidewalls of the squealer tip.

U.S. Pat. No. 5,511,946 issued to Lee et al on Apr. 30, 1996 entitled COOLED AIRFOIL TIP CORNER discloses a blade with a tip corner on the trailing edge having cooling holes that cross each other for improved cooling of the tip.

U.S. Pat. No. 5,660,523 issued to Lee on Aug. 26, 1997 entitled TURBINE BLADE SQUEALER TIP PERIPHERY END WALL WITH COOLING PASSAGE ARRANGEMENT discloses a turbine blade squealer tip with a cooling passages that cross one another to provide a larger cooling surface area and thereby more effective convective cooling that do separate single holes. The crossing cooling holes also cause for a more turbulent flow within the holes.

U.S. Pat. No. 6,932,571 B2 issued to Cunha et al on Aug. 23, 2005 entitled MICROCIRCUIT COOLING FOR A TURBINE BLADE TIP discloses a turbine blade with a tip having a microcircuit that traverses the tip between a suction sidewall and a pressure sidewall.

BRIEF SUMMARY OF THE INVENTION

The present invention is a turbine blade having a tip squealer in which a plurality of mini-serpentine cooling channels are arranged parallel with the tip cap to provide cooling for the tip cap of the blade. The mini-serpentine cooling channels can be either three-pass, four-pass or five-pass serpentine channel. An inlet to the serpentine channel communicates with the serpentine cooling channel within the blade internal cooling circuit. An exit to the serpentine cooling channel discharges cooling air onto the pressure side of the blade tip to provide film cooling. The mini-serpentine channels can be arranged parallel or transverse to the blade cordwise length. Trip strips are used in the serpentine flow channels to increase the internal heat transfer cooling. Thin film diffusion slots at the hole exit increase the film cooling effect of the blade.

The mini-serpentine cooling circuit of the present invention provides for numerous improvements over the cited prior art cooling circuits. The blade tip is easily repaired if damaged. Any blade tip treatment layer can be stripped and re-applied without plugging any cooling holes or re-opening tip cooling holes.

The need to drill holes in the blade tip is eliminated. Since the entire cooling scheme can be cast into the airfoil, drilling the cooling holes around the blade tip edge and blade top surface can be eliminated. This will reduce the blade manufacturing cost and improve the blade life cycle.

The blade core print-out hole is eliminated. The horizontal cooling channel and the metering hole can be used as the blade core print-out hole.

Elimination of welding of core print out holes is thus accomplished. Also, this integral blade tip cooling design will prevent core shift by inter-connecting the horizontal channels.

Cooling control flow is enhanced. Individual metering channels allow tailoring of the tip cooling flow to various supply and discharge pressure around the airfoil rip.

A high cooling effectiveness is obtained. Coolant air is used to cool the blade top surface by means of backside convective cooling, and then discharged into the airfoil surface as film cooling. This double usage of cooling air improves the overall cooling efficiency. Also, a higher film effectiveness level is produced by the peripheral film slot than by the conventional film hole, yielding a cooler blade tip.

A higher film cooling effectiveness is achieved. Thin diffusion film cooling slot yields higher film effectiveness and film coverage for the airfoil pressure side tip perimeter, and therefore achieves a better tip section cooling and lowers the tip section metal temperature.

DETAILED DESCRIPTION OF THE INVENTION

Figure 1:
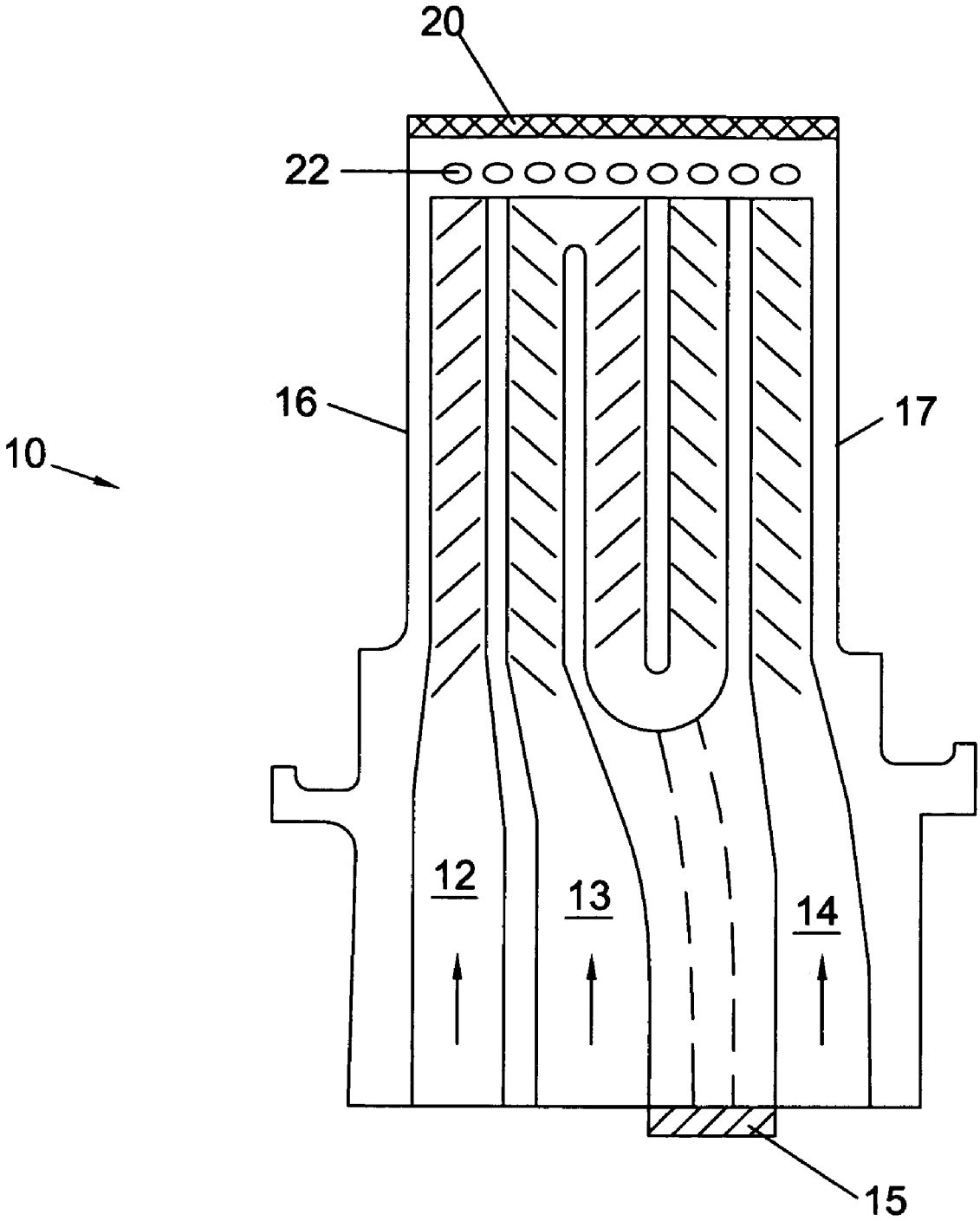
FIG. 1 shows a cross section view of a turbine blade having a serpentine cooling passage within the blade and cooling holes on the tip.

The present invention is a turbine blade used in a gas turbine engine, the blade having an internal cooling circuit for cooling the blade and a tip region. The tip of the blade is cooled with air supplied from the internal serpentine cooling passages and through a plurality of mini-serpentine cooling channels arranged along the surface that forms the blade top. The blade top also forms the floor for the squealer tip. FIG. 1 shows a cross section view of the blade 10 of the present invention, the blade including a leading edge 16 and a trailing edge 17, and three cooling supply channels. A leading edge cooling supply channel 12 supplies cooling air to a leading edge cooling structure such as a showerhead configuration. A mid-chord cooling supply channel 13 forms a serpentine passage through the interior of the blade. A trailing edge cooling supply channel 14 supplies cooling air to the trailing edge region through a plurality of cooling passages and discharge holes. An abrasive material 20 is applied to the tip rail 20.

Figure 2:
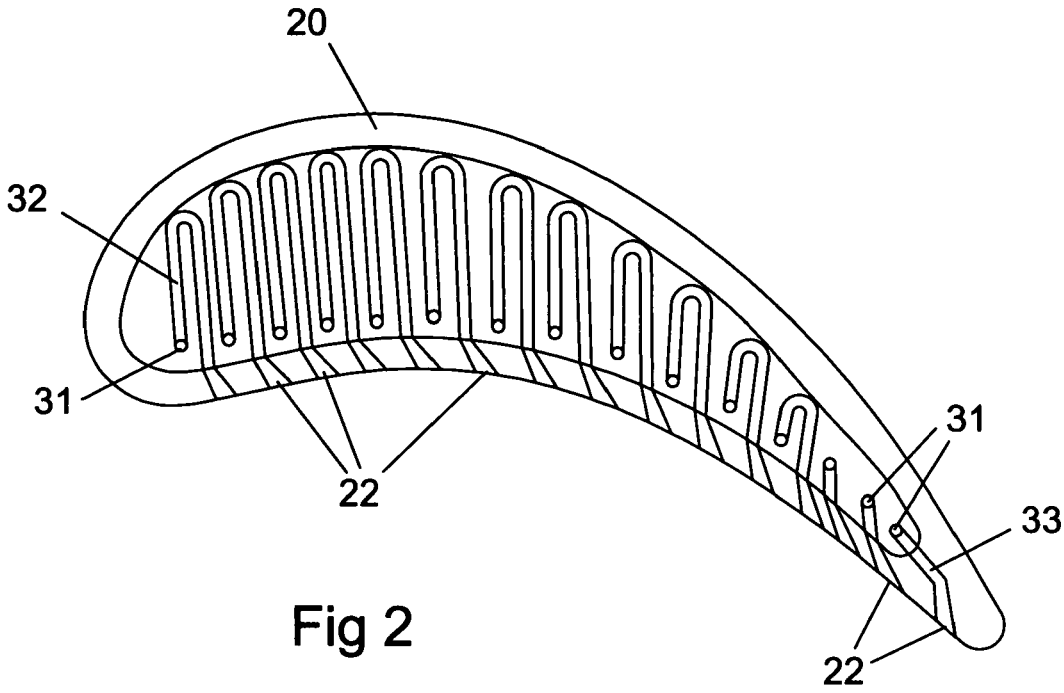
FIG. 2 shows a cross section view of the blade tip mini-serpentine cooling channels.
Figure 3:
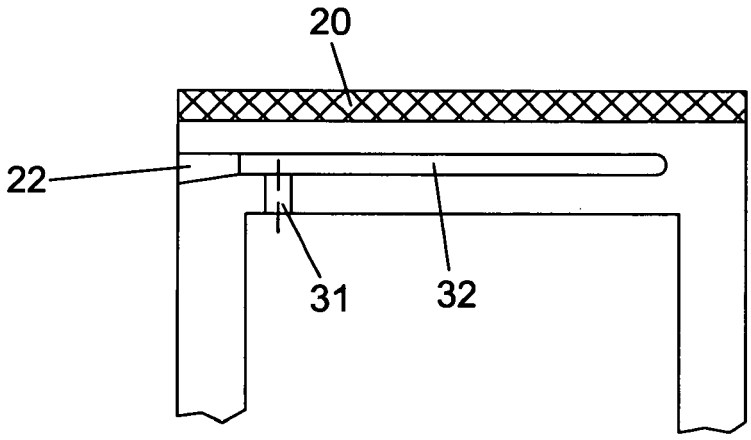
FIG. 3 shows a cross section view of a cut-away portion of the blade tip along one of the channels in FIG. 2.

The blade tip is formed by a squealer tip having a tip rail 20 (FIG. 2) extending around the perimeter of the tip on the pressure side and the suction side of the blade. The inside wall of the tip rail 20 and the top surface of the blade form a squealer pocket. A plurality of mini-serpentine cooling channels 32 are formed within the blade tip. The channels 32 can be 2-pass serpentine channels as shown in FIG. 2, or 3-pass, 4-pass, and 5-pass serpentine channels. Also, a variety of each can be used on a single blade depending upon the space available. An inlet cooling hole 31 for each mini-serpentine channel opens into one of the internal cooling passages (12, 13,14) passing through the blade to supply cooling air to the mini-serpentine channels. Each serpentine channel 32 also includes an exit hole 22 arranged on the pressure side of the blade at the tip. FIG. 1 shows the exit holes 22 arranged along the blade tip. FIG. 3 shows a cross section view of the serpentine channel 32 extending from side to side of the blade tip with the inlet hole 31 opening into the cooling supply passage below, and the exit hole 22 opening onto the pressure side of the blade 10. Each exit hole 22 includes a diffuser to provide improved film cooling flow. The mini-serpentine channels are formed in the blade tip during the casting process. However, the channels can be formed by machining after the blade has been cast.

A trailing edge portion of the blade uses straight cooling passages 33 instead of a serpentine passage because of the limited space. These trailing edge holes 22 discharge to the pressure side of the blade.

Figure 4:
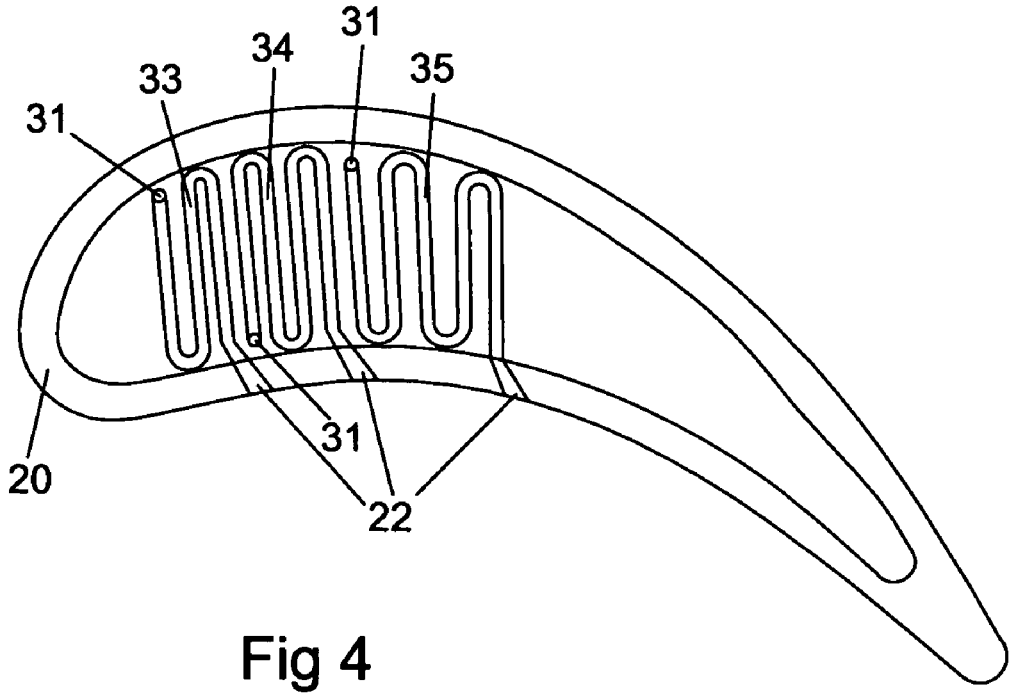
FIG. 4 shows a cross section view of a blade tip having embodiments with a 3-pass, a 4-pass, and a 5-pass mini-serpentine cooling channel, all in the circumferential direction of the blade tip.

FIG. 4 shows a blade tip having an assortment of mini-serpentine cooling channels that can be used to cool a blade tip. A three-pass circuit 33 is shown. A four-pass circuit 34 and a five-pass circuit 35 can also be used. Each serpentine cooling channel includes an inlet or supply hole 31 opening into one of the cooling passages within the blade, and an exit hole 22 on the pressure side of the blade to discharge film cooling air. In FIG. 4, the serpentine channels are shown arranged to run from side to side of the blade tip, in the circumferential direction. The blade tip can include all 3-pass, all 4-pass, or all 5-pass serpentine channels, or can use a variety of each according to the space available and the cooling requirements.

Figure 5:
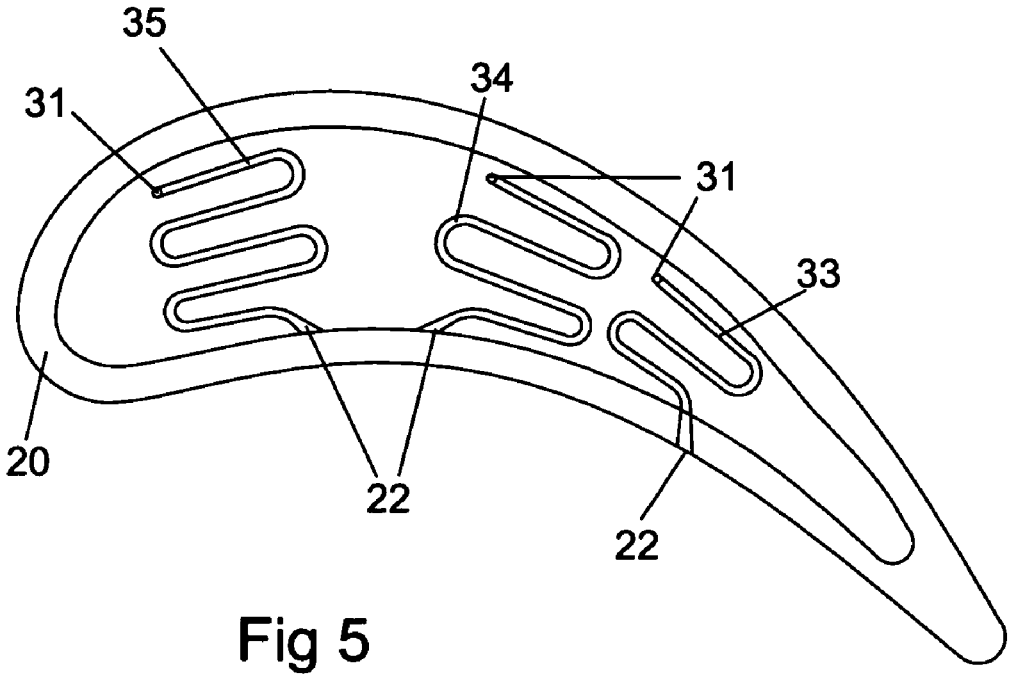
FIG. 5 shows embodiments with a 3-pass, a 4-pass, and a 5-pass mini-serpentine cooling channel, all in the chordwise direction of the blade tip.

FIG. 5 shows further embodiments of the 3-pass, 4-pass, and 5-pass serpentine channels. In FIG. 5, the channels flow in a leading edge to trailing edge direction, or a chordwise direction of the blade. A five-pass channel 35 is shown in the leading edge region, a 4-pass channel in the mid-blade region, and a 3-pass channel in the trailing edge region.

The blade tip is cooled by passing cooling air from the cooling supply passages (12,13,14) into the mini-serpentine cooling channels formed in the blade tip. Cooling air flows through the mini-serpentine channels to cool the blade tip, and then is discharged through the exit holes 22 onto the pressure side of the blade in the tip region to provide film cooling.

I claim:

1. A turbine blade comprising:

a wall forming an airfoil surface and having an internal cooling passage to channel cooling air through the blade for cooling;

a tip cap forming a blade tip; and, a mini-serpentine cooling channel formed in the blade, the mini-serpentine cooling channel having an inlet in fluid communication with the internal cooling passage and an exit on the surface of the blade, whereby cooling air passes through the mini-serpentine cooling channel to cool the tip and discharges onto the blade surface to provide film cooling and, the mini-serpentine cooling channel having at least a first leg and a second leg in which both legs extend from near the pressure side wall of the blade tip to the suction side wall.

2. The turbine blade of claim 1, and further comprising:

the exit hole of the mini-serpentine cooling channel is located on the pressure side of the blade.

3. The turbine blade of claim 1, and further comprising:

a plurality of mini-serpentine cooling passages arranged side-by-side.

4. The turbine blade of claim 3, and further comprising:

the plurality of mini-serpentine passages can be all or a variety of 2-pass channels, 3-pass channels, 4-pass channels, and 5-pass channels.

5. The turbine blade of claim 3, and further comprising:

the mini-serpentine cooling channels extend from one side of the blade tip to an opposite side of the blade tip.

6. The turbine blade of claim 3, and further comprising:

the mini-serpentine cooling channels extend from the leading edge of the blade to the trailing edge of the blade.

7. A process for cooling a tip of a turbine blade, the turbine blade having an internal cooling supply passage to pass cooling air through the blade for cooling, the blade having a tip forming a seal between the blade tip and an outer shroud, the process comprising the steps of:

passing cooling air through the internal cooling passage of the blade;

passing cooling air through a mini-serpentine cooling channel formed within the blade tip through a first leg of the mini-serpentine channel that extends from one side of the blade tip to the opposite side and then through a second leg that is substantially parallel to the first leg; and, discharging the cooling air from the mini-serpentine cooling channel onto the blade surface.

8. The process for cooling a tip of a turbine blade of claim 7, and further comprising the step of:

Discharging the cooling air from the mini-serpentine cooling channel onto the pressure side of the blade.

9. The process for cooling a tip of a turbine blade of claim 7, and further comprising the step of:

passing cooling air through a plurality of mini-serpentine cooling channels formed within the blade tip.

10. The process for cooling a tip of a turbine blade of claim 9, and further comprising the step of:

supplying cooling air to at least two of the plurality of mini-serpentine cooling channels with cooling air from different internal cooling passages within the blade.

11. The process for cooling a tip of a turbine blade of claim 7, and further comprising the step of:

passing the cooling air in the mini-serpentine cooling channels in a direction substantially from side to side of the blade tip.

12. The process for cooling a tip of a turbine blade of claim 7, and further comprising the step of:

passing the cooling air in the mini-serpentine cooling channels in a direction substantially from edge to edge of the blade tip.

* * * * *